US006933667B2

(12) United States Patent
Miyazaki

(10) Patent No.: US 6,933,667 B2
(45) Date of Patent: Aug. 23, 2005

(54) DEFLECTION YOKE HAVING SHORT-CIRCUITED COIL IN CONVERGENCE YOKE PORTION

(75) Inventor: Masahiko Miyazaki, Daito (JP)

(73) Assignees: Sanyo Electric Co., Ltd., Moriguchi (JP); Sanyo Electronic Components Co., Ltd., Daito (JP)

( * ) Notice: Subject to any disclaimer, the term of this patent is extended or adjusted under 35 U.S.C. 154(b) by 131 days.

(21) Appl. No.: 10/620,466

(22) Filed: Jul. 17, 2003

(65) Prior Publication Data

US 2004/0017145 A1 Jan. 29, 2004

(30) Foreign Application Priority Data

Jul. 19, 2002 (JP) ..... 2002-211680

(51) Int. Cl.[7] ..... H01J 29/70

(52) U.S. Cl. ..... 313/440; 313/413; 335/213; 315/368.25

(58) Field of Search ..... 313/440, 442, 313/412–413; 315/368.11, 368.25, 368.26, 368.27, 368.28, 382; 335/210, 213

(56) References Cited

U.S. PATENT DOCUMENTS 5,172,035 A * 12/1992 Sakurai et al. ..... 315/368.25
5,430,351 A * 7/1995 Yokota ..... 313/440
6,737,818 B2 * 5/2004 Sakurai et al. ..... 315/382

* cited by examiner

*Primary Examiner*—Karabi Guharay
(74) *Attorney, Agent, or Firm*—Armstrong, Kratz, Quintos, Hanson & Brooks, LLP

(57) ABSTRACT

The invention provides a deflection yoke device comprising a main yoke portion 4 for deflecting an electron beam emitted by an electron gun, and a convergence yoke portion 5 for adjusting the convergence of the electron beam. The convergence yoke portion 5 comprises an annular convergence core 53, a convergence horizontal coil 51 wound around both of left and right two regions of the core 53 which intersect a horizontal axis, and a convergence vertical coil 52 wound around both of upper and lower two regions of the core 53 which intersect a vertical axis. Short-circuited coils 54, 54 are provided around the respective left and right two regions of the core 53.

7 Claims, 6 Drawing Sheets

DEFLECTION YOKE HAVING SHORT-CIRCUITED COIL IN CONVERGENCE YOKE PORTION

FIELD OF THE INVENTION

The present invention relates to deflection yoke devices for use in the picture tubes of video display devices such as color television devices.

BACKGROUND OF THE INVENTION

Color television devices of the projection type for projecting video images on a screen in front of the device are provided with three video display devices for R (red), G (green) and B (blue). These display devices are arranged as directed toward the screen in front of the devices.

Each of the video display devices comprises a picture tube 2 and a deflection yoke device 10 as shown in FIG. 6. The picture tube 2 comprises a cone portion 21, a neck portion 22 projecting from a small-diameter end of the cone portion 21, and a face plate 23 formed at a large-diameter end of the cone portion 21, these components being joined into an integral assembly. The neck portion 22 has an electron gun 3 housed therein. The deflection yoke device 10 extends from part of the cone portion 21 of the tube 2 to the neck portion 22 thereof, as provided around these portions. In the drawings to be referred to hereinafter, the horizontal direction and the vertical direction of the picture tube 2 are represented by the X-axis and the Y-axis, respectively, and the direction toward which an electron beam is emitted from the electron gun 3 is represented by the Z-axis.

With reference to FIG. 7, the deflection yoke device 10 comprises a main yoke portion 4 for deflecting the electron beam emitted by the electron gun 3, and a convergence yoke portion 50 for adjusting the convergence of the electron beam. The convergence yoke portion 50 is positioned to the rear of the main yoke portion 4 in proximity thereto. Incidentally, FIG. 7 includes a side elevation partly broken away and showing the upper half of the deflection yoke device 10 and a view in vertical section and showing the lower half of the device 10.

The main yoke portion 4 comprises a main yoke horizontal coil 6 provided along the inner peripheral surface of a conical bobbin 80, a core 8 provided around the outer peripheral surface of the bobbin 80, and a main yoke vertical coil 7 wound around the core 8. By passing current through the main yoke horizontal coil 6, a horizontal magnetic field is produced inside the picture tube 2. A vertical magnetic field is set up inside the picture tube 2 by passing current through the main yoke vertical coil 7. The electron beam emitted by the electron gun 3 is deflected horizontally and vertically by these magnetic fields.

When a periodic sawtooth current is passed through the main yoke horizontal coil 6 and the main yoke vertical coil 7, the electron beam scans the face plate 23 of the picture tube 2 in a horizontal direction and a vertical direction, thereby producing images on the face plate 23. R, G, B images produced by the three video display devices are projected as enlarged on the screen in front, and the images are superimposed to display color images on the screen. In digital color television devices of recent years, a sawtooth current having a frequency of 31.5 KHz is used for horizontal scanning, and like current with a frequency of 60.0 Hz for vertical scanning.

With reference to FIG. 9, the convergence yoke portion 50 comprises an annular convergence core 53, a convergence horizontal coil 51 wound around the core 53, and a convergence vertical coil 52 similarly wound. The convergence horizontal coil 51 is wound around both of left and right two regions of the core 53 which intersect the X-axis and has opposite ends connected to a horizontal convergence correction circuit 11. The convergence vertical coil 52 is wound around both of upper and lower two regions of the core 53 which intersect the Y-axis and has opposite ends connected to a vertical convergence correction circuit 12.

When current is passed through the convergence horizontal coil 51 in a direction indicated by arrows in the drawing, a magnetic field is produced in the interior space $S_0$ of the picture tube 2, the magnetic field pointing from above downward as indicated by solid-line arrows in FIG. 9. An electron beam 9 emanating from the electron gun 3 toward the viewer of the drawing perpendicular to the plane of the drawing is deflected by the magnetic field toward the right in the drawing. Further when current is passed through the convergence vertical coil 52 in a direction indicated by arrows in the drawing, a magnetic field pointing from the right toward the left is produced in the upper half of the interior space $S_0$ and a magnetic field pointing from the left toward the right is produced in the lower half thereof as indicated by broken-line arrows in the drawing. The electron beam 9 is deflected by the magnetic fields downward in the drawing.

Accordingly, RGB three electron beams, even if deflected in any direction, can be converged toward one point on the face plate of the picture tube by adjusting the currents to be passed through the convergence horizontal coils 51 and the convergence vertical coils 52 of the R, G, B video display devices, whereby RGB three images can be perfectly superimposed on the screen.

When a current having a horizontal scanning frequency is passed through the main yoke horizontal coil 6 shown in FIG. 8, a fluctuation magnetic field m is set up around the base portion 60 of the coil 6 in a direction perpendicular to the flow of current. With reference to FIG. 7 showing the deflection yoke device 10, the convergence yoke portion 50 is positioned close to the base portion 60 of the main yoke horizontal coil 6, so that the fluctuation magnetic field m produced by the base portion 60 ingresses into the convergence yoke portion 50 on leakage, generating induction voltage in the convergence horizontal coil 51 due to the leakage field.

FIG. 10 shows the result obtained by measuring variations with time in the induction voltage produced in the convergence horizontal coil 51 when a sawtooth current having a horizontal scanning frequency of 31.5 KHz is passed through the main yoke horizontal coil 6, with a sawtooth current having a vertical scanning frequency of 60.0 Hz passed through the main yoke vertical coil 7. The graph reveals a marked rise in the voltage of the convergence horizontal coil 51 in horizontal scanning cycles of 31.75 $\mu$S. Presumably, this indicates that leakage of the fluctuation magnetic field m from the main yoke horizontal coil 6 produces induction voltage in the convergence horizontal coil 51. With actual devices, the fluctuation magnetic field of the main yoke portion periodically produces a voltage of at least 10 V in the convergence horizontal coil.

Thus with the deflection yoke device 10 shown in FIG. 7, the induction voltage produced in the convergence horizontal coil 51 of the convergence yoke portion 50 poses the problem of presenting difficulty in adjusting the convergence by the horizontal coil 51. This problem may presumably be solved by providing a circuit for removing the fluctuation magnetic field from the main yoke portion 4, whereas this not only makes complex the circuit to be connected to the deflection yoke device 10 but also entails the problem of necessitating expensive pressure-resistant circuit components for constituting the removal circuit.

SUMMARY OF THE INVENTION

An object of the present invention is to provide a deflection yoke device of simple construction which is adapted to effectively suppress the induction voltage to be produced in a convergence yoke portion due to a leakage magnetic field from a main yoke portion without providing a removal circuit or like special circuit.

The present invention provides a deflection yoke device comprising a main yoke portion for deflecting an electron beam emitted by an electron gun, and a convergence yoke portion for adjusting the convergence of the electron beam, the main yoke portion and the convergence yoke portion being coaxially arranged as positioned in proximity to each other, the convergence yoke portion being provided with a coil having short-circuited opposite ends.

With the deflection yoke device of the invention, the convergence yoke portion is provided with a short-circuited coil, so that even if a fluctuation magnetic field leaks from the main yoke portion and ingresses into the convergence yoke portion, the short-circuited coil generates a magnetic field in such a direction as to offset the leakage magnetic field. This greatly lessens the influence of the leakage field to be exerted on the convergence yoke portion, effectively suppressing the induction voltage generated in the convergence yoke portion due to the leakage field.

Stated specifically, the convergence yoke portion comprises an annular convergence core, a convergence horizontal coil wound around both of left and right two regions of the core which intersect a horizontal axis, and a convergence vertical coil wound around both of upper and lower two regions of the core which intersect a vertical axis, the short-circuited coil being provided around each of the left and right two regions of the convergence core.

With this specific construction, a leakage magnetic field from the main yoke portion will act mainly on the left and right two regions of the convergence core having the convergence horizontal coil wound therearound, whereas these regions are each provided with the short-circuited coil, which induces a magnetic field of opposite direction to the leakage field. Consequently, the induction voltage produced in the convergence yoke portion by the leakage field from the main yoke portion is almost completely suppressed. However, since no short-circuited coil is wound around the regions provided with the convergence vertical coil, the convergence correcting magnetic field to be produced by the convergence vertical coil is free of any influence.

As described above, the deflection yoke device of the present invention is capable of suppressing the induction voltage to be generated in the convergence yoke portion by a simple construction wherein a short-circuited coil only is provided on the convergence yoke portion, without providing a special circuit, such as a circuit for removing the fluctuation magnetic field from the main yoke portion. This ensures more accurate convergence correction than is conventionally made.

BRIEF DESCRIPTION OF THE DRAWINGS

FIG. 4(*b*) is a graph showing the result obtained by measuring the voltage across the terminals of a convergence vertical coil of the deflection yoke device of the invention;

DETAILED DESCRIPTION OF EMBODIMENTS

The present invention as embodied into video display devices for a color television device of the projection type will be described below in detail with reference to the drawings.

Figure 2:
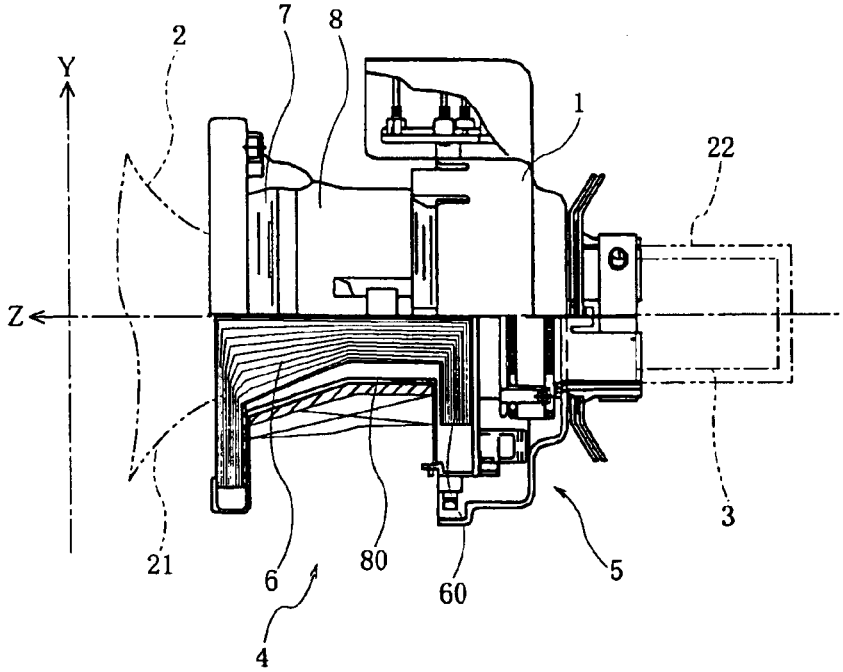
FIG. 2 is a side elevation partly broken away and showing the deflection yoke device.

With reference to FIG. 2, a deflection yoke device 1 of the invention, which is mounted on a picture tube 2, extends from part of a cone portion 21 of the tube 2 to a neck portion 22 thereof, as provided around these portions. The device 1 comprises a main yoke portion 4 for deflecting an electron beam emitted by an electron gun 3, and a convergence yoke portion 5 for adjusting the convergence of the electron beam. The convergence yoke portion 5 is positioned to the rear of the main yoke portion 4 in proximity thereto. Incidentally, FIG. 2 includes a side elevation partly broken away and showing the upper half of the deflection yoke device 1 and a view in vertical section and showing the lower half of the device 1.

The main yoke portion 4 comprises a main yoke horizontal coil 6 provided along the inner peripheral surface of a conical bobbin 80, a core 8 provided around the outer peripheral surface of the bobbin 80, and a main yoke vertical coil 7 wound around the core 8.

Figure 1:
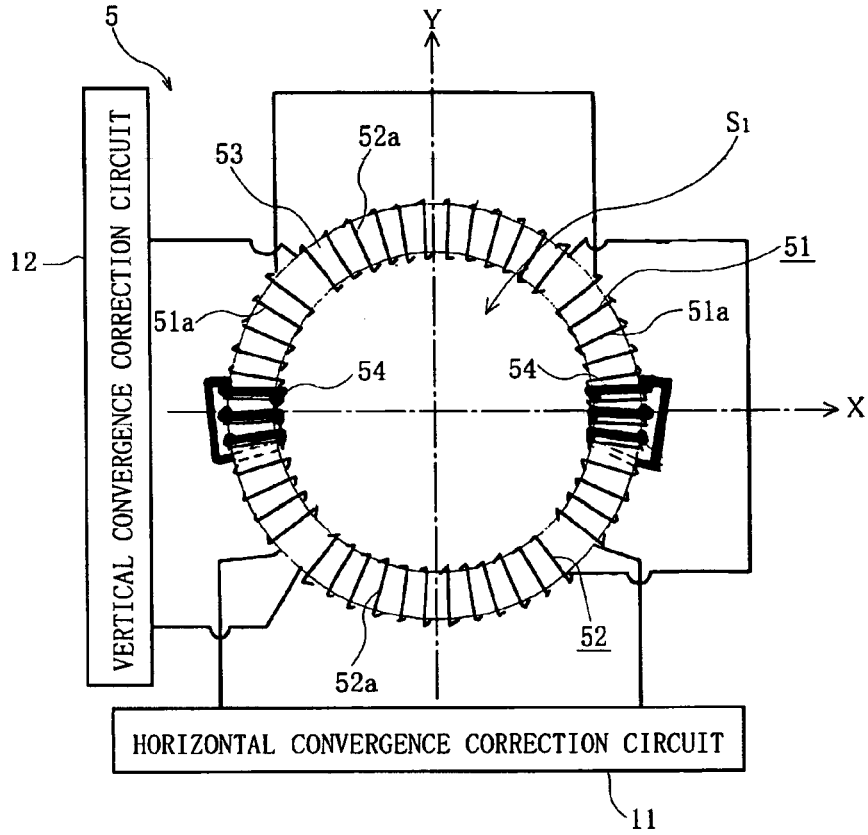
FIG. 1 is a front view showing a convergence yoke portion of a deflection yoke device according to the invention.

With reference to FIG. 1, the convergence yoke portion 5 comprises an annular convergence core 53, a convergence horizontal coil 51 wound around the core 53, and a convergence vertical coil 52 similarly wound. The convergence horizontal coil 51 comprises a pair of left and right horizontal coil portions 51*a*, 51*a* each provided over an angular range of up to 90 degrees and wound respectively around left and right two regions of the core 53 which intersect the X-axis. The coil 51 has opposite ends connected to a horizontal convergence correction circuit 11. The convergence vertical coil 52 comprises a pair of upper and lower vertical coil portions 52*a*, 52*a* each provided over an angular range of up to 90 degrees and wound respectively around upper and lower two regions of the core 53 which intersect the Y-axis. The coil 52 has opposite ends connected to a vertical convergence correction circuit 12.

The convergence core 53 further has short-circuited coils 54, 54 each having one to several turns and wound respectively around left and right two portions of the core 53 which intersect the X-axis. Each coil 54 has opposite ends which are short-circuited.

When current is passed through the convergence horizontal coil 51 of the convergence yoke portion 5 shown in FIG. 1, a magnetic field is produced in an interior space $S_1$ of the picture tube 2 and exerts a force on an electron beam emitted from the electron gun 3 toward the viewer of the drawing perpendicular to the plane of the drawing, whereby the electron beam is deflected in a horizontal direction. Further when current is passed through the convergence vertical coil 52, a magnetic field is generated in the interior space $S_1$, exerting a force on the electron beam to deflect the beam in a vertical direction. The horizontal convergence correction circuit 11 and the vertical convergence correction circuit 12 adjust the currents to be passed through the two coils 51, 52 so that the R, G, B three images projected on the screen from R, G, B three video display devices will be in register at any location on the screen.

In the deflection yoke device 1 of the present invention, the convergence yoke portion 5 is positioned in the vicinity of the base portion 60 of the main yoke horizontal coil 6 as shown in FIG. 2, so that a fluctuation magnetic field produced by the base portion 60 will leak to ingress into the convergence yoke portion 5. However, the convergence core 53 of the convergence yoke portion 5 is provided with the short-circuited coils 54, 54 around the left and right two regions thereof intersecting the X-axis as shown in FIG. 1, i.e. around the regions subjected to the action of the leakage magnetic field. These short-circuited coils 54, 54 therefore induce a magnetic field of opposite direction to the leakage field. Consequently, the induction voltage produced in the convergence yoke portion 5 by the leakage field from the main yoke horizontal coil 6 is almost completely suppressed.

Figure 3:
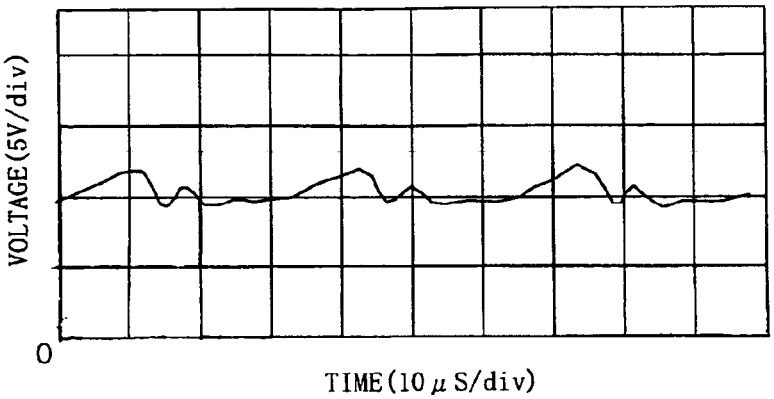
FIG. 3 is a graph showing the result obtained by measuring variations with time in the induction voltage produced in a convergence horizontal coil due to a magnetic field from a main yoke horizontal coil of the deflection yoke device.
Figure 10:
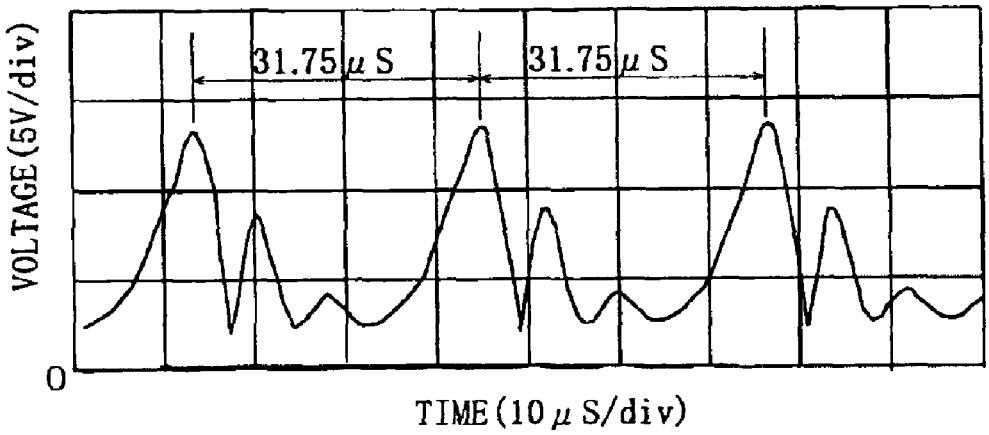
FIG. 10 PRIOR ART
FIG. 10 is a graph showing the result obtained by measuring variations with time in the induction voltage produced in a convergence horizontal coil due to a magnetic field from a main yoke horizontal coil of the deflection yoke device.

FIG. 3 shows the result obtained by measuring variations with time in the induction voltage produced in the convergence horizontal coil 51 when a sawtooth current having a horizontal scanning frequency of 31.5 KHz is passed through the main yoke horizontal coil 6, with a sawtooth current having a vertical scanning frequency of 60.0 Hz passed through the main yoke vertical coil 7. The graph reveals that slight induction voltage is produced by the leakage field but is up to 5 V if greatest, and is much smaller than the maximum voltage in the conventional deflection yoke device 10 shown in FIG. 10. This substantiates that the leakage magnetic field from the main yoke horizontal coil 6 is offset by the magnetic field of the pair of short-circuited coils 54, 54.

Since no short-circuited coil 54 is wound around the regions provided with the convergence vertical coil 52, the convergence correcting magnetic field to be produced by the convergence vertical coil 52 is free of any influence.

Figure 4A:
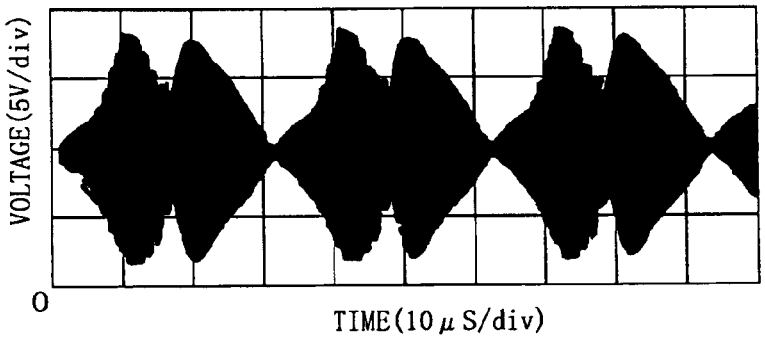
FIG. 4(*a*) is a graph showing the result obtained by measuring the voltage across the terminals of a convergence vertical coil of a conventional deflection yoke device.
Figure 4B:
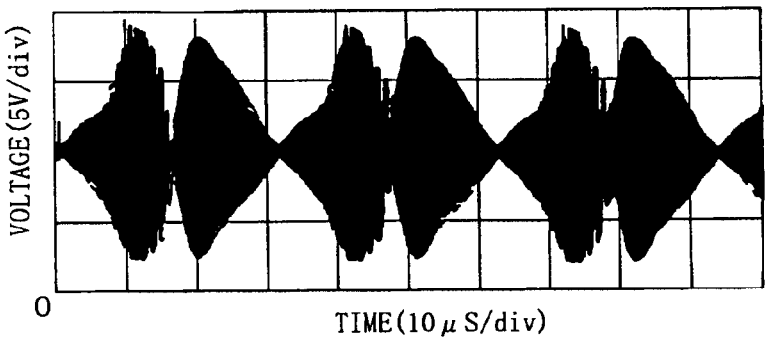

FIG. 4(*a*) shows the result achieved by the conventional deflection yoke device 10 and obtained by measuring the voltage across the terminals of the convergence vertical coil 52, with the main yoke portion 4 in operation. FIG. 4(*b*) shows the result achieved by the deflection yoke device 1 of the invention and obtained by measuring the voltage across the terminals of the convergence vertical coil 52, with the main yoke portion 4 in operation. The graphs reveal that the variations in the voltage across the terminals of the convergence vertical coil 52 have the same waveform regardless of the presence or absence of the pair of short-circuited coils 54, 54. This indicates that accurate convergence can be effected by the convergence vertical coil 52 despite the presence of the short-circuited coils 54, 54.

As described above, the deflection yoke device 1 of the present invention is capable of effectively suppressing the induction voltage to be generated in the convergence horizontal coil 51 by offsetting a magnetic field leaking from the main yoke portion 4 and acting on this horizontal coil 51, using a simple construction wherein short-circuited coils 54, 54 only are provided on the convergence yoke portion 5, without providing a special circuit, such as a circuit for removing the fluctuation magnetic field from the main yoke portion 4. This ensures more accurate horizontal convergence correction than is conventionally possible.

Figure 5:
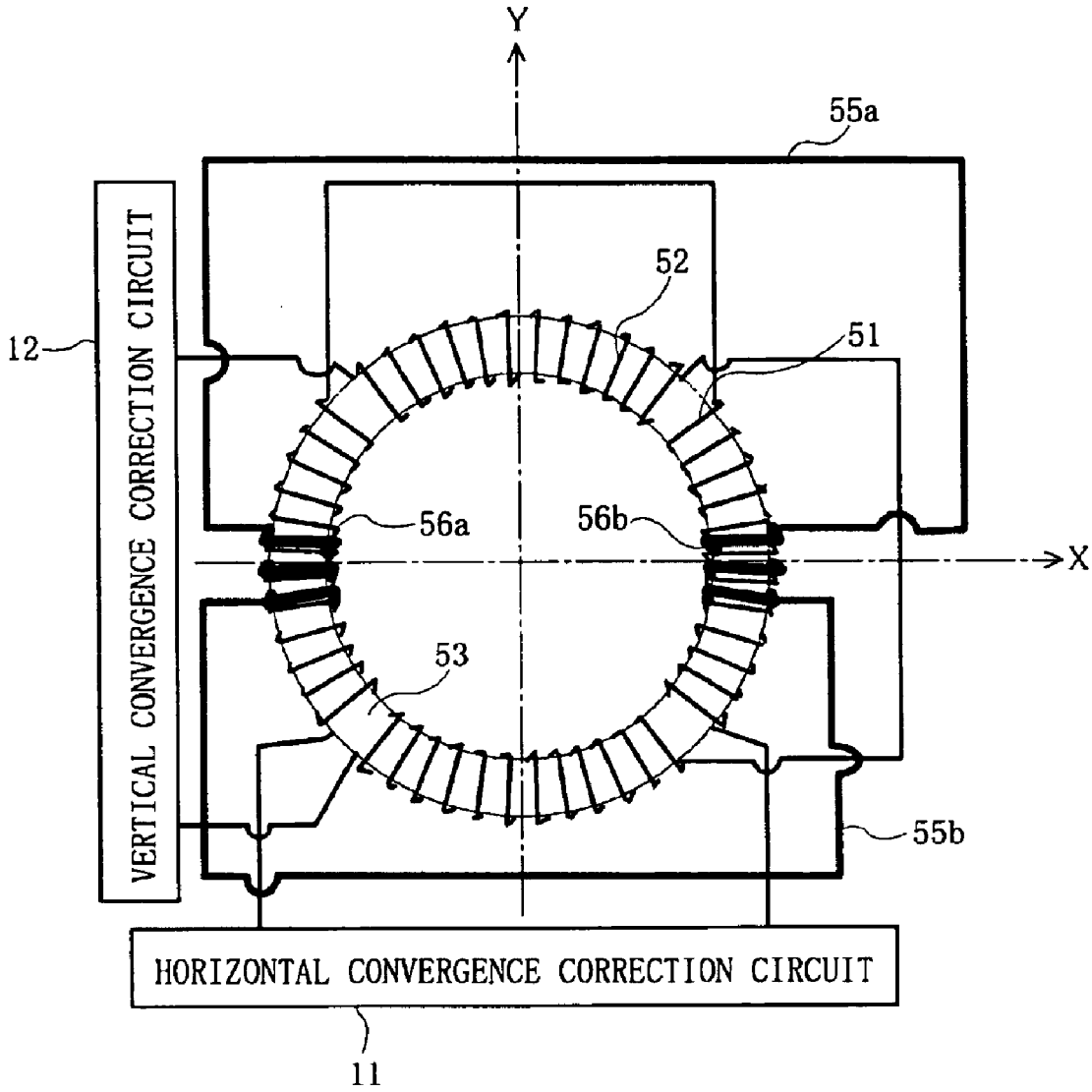
FIG. 5 is a front view showing a different construction of convergence yoke portion of the deflection yoke device of the invention.
Figure 6:
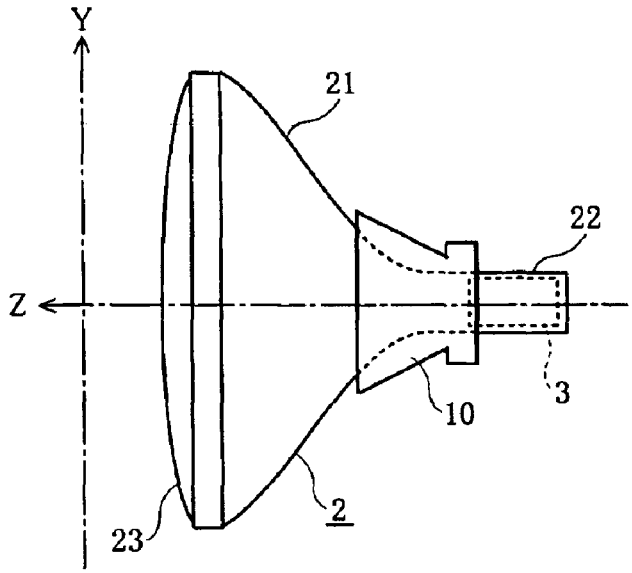
FIG. 6 PRIOR ART
FIG. 6 is a side elevation of a picture tube equipped with the conventional deflection yoke device.
Figure 7:
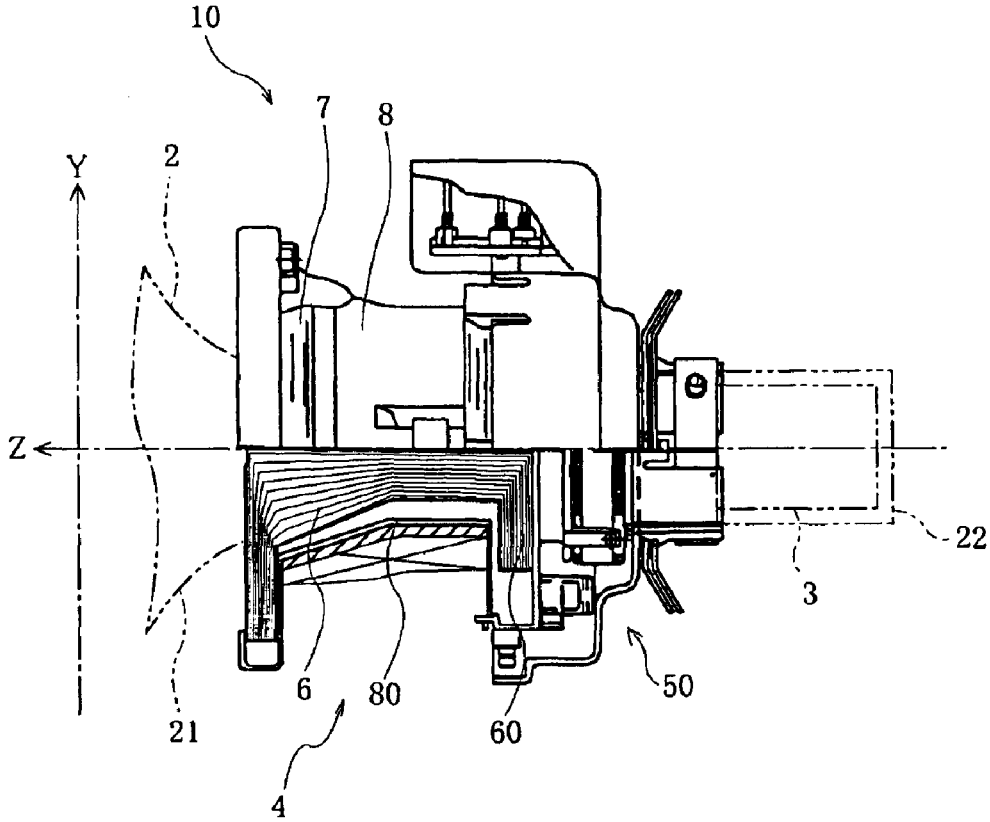
FIG. 7 PRIOR ART
FIG. 7 is a side elevation partly broken away and showing the deflection yoke device.
Figure 8:
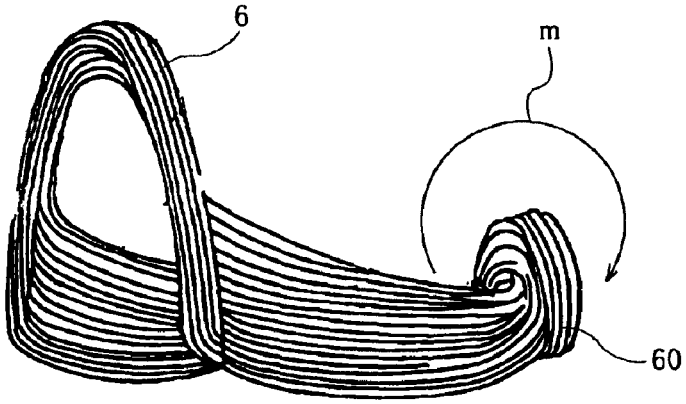
FIG. 8 PRIOR ART
FIG. 8 is a perspective view showing a main yoke horizontal coil of the deflection yoke device.
Figure 9:
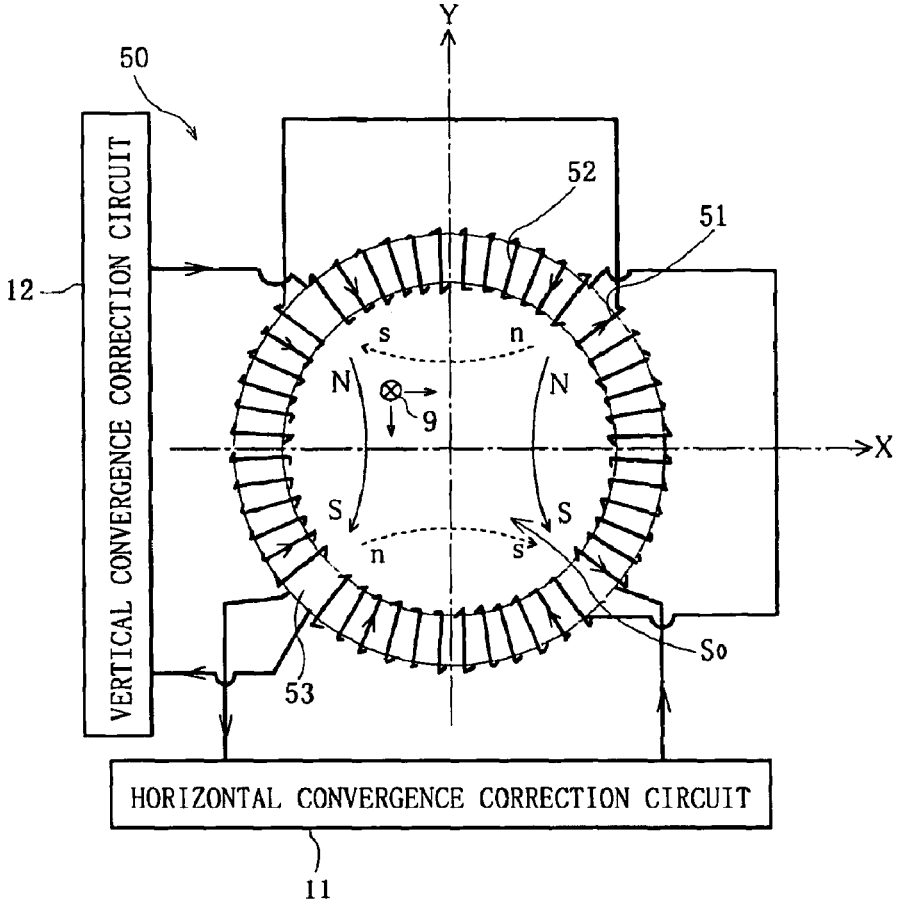
FIG. 9 PRIOR ART
FIG. 9 is a front view of a convergence yoke portion of the deflection yoke device.

The device of the present invention is not limited to the foregoing embodiments in construction but can be modified variously by one skilled in the art without departing from the spirit of the invention as set forth in the appended claims. For example as shown in FIG. 5, the pair of coils 56*a*, 56*b* arranged on the convergence core 53 can be so short-circuited that one of these coils, 56*a*, is connected at one end thereof to one end of the other coil 56*b* by a bridge line 55*a*, and the other end of said one coil 56*a* is connected to the other end of the other coil 56*b* by a bridge line 55*b*.

What is claimed is:

1. A deflection yoke device comprising a main yoke portion for deflecting an electron beam emitted by an electron gun, and a convergence yoke portion for adjusting the convergence of the electron beam, the main yoke portion and the convergence yoke portion being coaxially arranged as positioned in proximity to each other, the convergence yoke portion being provided with a coil having short-circuited opposite ends, wherein the convergence yoke portion comprises an annular convergence core a convergence horizontal coil wound around a region of the core, and wherein the short-circuited coil is provided around the region of the core on which the convergence horizontal coil is wound.

2. A deflection yoke device according to claim 1 wherein the convergence yoke portion comprises a convergence horizontal coil wound around both of left and right two regions of the core which intersect a horizontal axis, and a convergence vertical coil wound around both of upper and lower two regions of the core which intersect a vertical axis, the short-circuited coil being provided around each of the left and right two regions of the core.

3. A deflection yoke device according to claim 2 wherein the two short-circuited coils provided around the respective left and right two regions of the core each have opposite ends connected to each other.

4. A deflection yoke device according to claim 2 wherein one end of one of the two short-circuited coils provided around the respective left and right two regions of the core is connected to one end of the other short-circuited coil, and the other end of said one short-circuited coil is connected to the other end of the other short-circuited coil.

5. A deflection yoke device according to claim 2 wherein the short-circuited coils each have at least one turn.

6. A deflection yoke device according to claim 2 wherein the convergence horizontal coil is connected at opposite ends thereof to a horizontal convergence correction circuit, and the convergence vertical coil is connected at opposite ends thereof to a vertical convergence correction circuit.

7. A deflection yoke device comprising a main yoke portion for deflecting an electron beam emitted by an electron gun, and a convergence yoke portion for adjusting the convergence of the electron beam, the main,yoke portion and the convergence yoke portion being coaxially arranged as positioned in proximity to each other, the convergence yoke portion being provided with a coil having short-circuited opposite ends, wherein the convergence yoke portion comprises an annular convergence core a convergence horizontal coil being wound around both of left and right two regions of the core which intersect a horizontal axis, the short-circuited coil being provided around each of the left and right two regions of the core.

* * * * *